US009371574B2

(12) United States Patent
Kaneno et al.

(10) Patent No.: US 9,371,574 B2
(45) Date of Patent: Jun. 21, 2016

(54) $NI_3$(SI, TI)-BASED INTERMETALLIC COMPOUND TO WHICH W IS ADDED, AND METHOD FOR PRODUCING SAME

(75) Inventors: Yasuyuki Kaneno, Sakai (JP); Takayuki Takasugi, Sakai (JP)

(73) Assignee: OSAKA PREFECTURE UNIVERSITY PUBLIC CORPORATION, Sakai-shi (JP)

( * ) Notice: Subject to any disclaimer, the term of this patent is extended or adjusted under 35 U.S.C. 154(b) by 775 days.

(21) Appl. No.: 13/395,773

(22) PCT Filed: Sep. 14, 2010

(86) PCT No.: PCT/JP2010/065835

§ 371 (c)(1), (2), (4) Date: Mar. 26, 2012

(87) PCT Pub. No.: WO2011/030904

PCT Pub. Date: Mar. 17, 2011

(65) Prior Publication Data

US 2012/0216922 A1 Aug. 30, 2012

(30) Foreign Application Priority Data

Sep. 14, 2009 (JP) ..... 2009-212085

(51) Int. Cl.
*C22F 1/10* (2006.01)
*C22C 19/03* (2006.01)

(52) U.S. Cl.
CPC . *C22F 1/10* (2013.01); *C22C 19/03* (2013.01); *Y10T 428/12* (2015.01)

(58) Field of Classification Search
CPC ..... C22C 19/03; C22F 1/10
USPC ..... 420/441; 148/676, 426
See application file for complete search history.

(56) References Cited

U.S. PATENT DOCUMENTS 3,311,470 A * 3/1967 Evans et al. ..... 420/458

FOREIGN PATENT DOCUMENTS

| | | | |
|---|---|---|---|
| JP | 4-246144 | A | 9/1992 |
| JP | 4-268037 | A | 9/1992 |
| JP | 5-320794 | A | 12/1993 |
| JP | 08-060278 | A | 3/1996 |
| JP | 2006-299410 | A | 11/2006 |
| JP | 2007-84903 | A | 4/2007 |
| JP | 2008-266754 | A | 11/2008 |

(Continued)

OTHER PUBLICATIONS

Machine translation of JP2007084903A Apr. 2007.*

(Continued)

*Primary Examiner* — Jie Yang
(74) *Attorney, Agent, or Firm* — Birch, Stewart, Kolasch & Birch, LLP

(57) ABSTRACT

The present invention provides a structural material having enhanced ductility characteristics at high temperatures and enhanced strength characteristics. The present invention provides an $Ni_3$(Si, Ti)-based intermetallic compound characterized by containing from 25 to 500 ppm by weight of B with respect to a weight of an intermetallic compound having a composition of 100% by atom in total consisting of Ni as a main component, from 7.5 to 12.5% by atom of Si, from 4.5 to 11.5% by atom of Ti and from 0.5 to 5.0% by atom of W.

14 Claims, 14 Drawing Sheets

(56) References Cited

FOREIGN PATENT DOCUMENTS

| | | |
|---|---|---|
| JP | 2009-97094 A | 5/2009 |
| JP | 2010-31323 A | 2/2010 |

OTHER PUBLICATIONS

International Search Report issued in PCT/JP2010/065835 dated Dec. 14, 2010.
T. Takasugi et al., "Mechanical properties of recrystallized L12-Type Ni3 (Si, Ti) intermetallics", Journal of Materials Science 26. pp. 1173-1178 (1991).
Hasegawa et al., "Mechanical properties of Co3 Ti with simultaneous additions of tungsten and boron", Materials Science and Technology, Jan. 1993, vol. 9, pp. 61-66.
Extended European Search Report, issued Jul. 6, 2015, for European Application No. 10815494.9.
Fujimoto et al., "Alloying Effect on Mechanical Properties and Oxidation Resistance of Cold-Rolled $Ni_3$(Si,Ti) Foils," Mater. Res. Soc. Symp. Proc., vol. 1128, 2009, 6 pages, XP-55197301A.
Kaneno et al., "Tensile Properties of $L1_2$ Intermetallic Foils Fabricated by Cold Rolling," Int. J. Mat. Res., vol. 99, 2008, pp. 1229-1236, XP-001519068.
Mishima et al., "Lattice Parameters of Ni(γ), $Ni_3Al$(γ') and $Ni_3Ga$(γ') Solid Solutions with Additions of Transition and B-subgroup Elements," Acta metall, vol. 33, No. 6, 1985, pp. 1161-1169, XP-24023571A.
Nakamura et al., "The Effect of Second-phase Ni Solid Solution on Environmental Embrittlement of $L1_2$-type $Ni_3$(Si,Ti) Ordered Alloys," Materials Science and Engineering A, vol. 383, 2004, pp. 259-270, XP-4552687A.
Ochiai et al., "Alloying Behaviour of $Ni_3Al$, $Ni_3Ga$, $Ni_3Si$ and $Ni_3Ge$," Acta metall, vol. 32, No. 3, 1984, pp. 289-298, XP-24024499A.

* cited by examiner (1) Cold-Rolled Foil (2) Annealing at 600°C for 1h (3) Annealing at 900°C for 1h Note: (1) to (3) are Example Sample 1, and (4) to (6) are Comparative Example Sample (1) Example Sample 2 (0.5W)

(2) Example Sample 1 (2.0W)

(3) Example Sample 3 (4W)

$NI_3$(SI, TI)-BASED INTERMETALLIC COMPOUND TO WHICH W IS ADDED, AND METHOD FOR PRODUCING SAME

TECHNICAL FIELD

The present invention relates to an $Ni_3$(Si, Ti)-based intermetallic compound to which W is added and to a method for producing the same.

BACKGROUND ART $Ni_3Si$ intermetallic compounds, which are nickel intermetallic compounds, have excellent characteristics such as high-temperature strength, corrosion resistance and oxidation resistance. However, polycrystalline $Ni_3Si$ intermetallic compounds are brittle as being prone to intergranular fracture, and therefore an intermetallic compound having enhanced ductility and enabled for plastic working at room temperature has been desired. To this end, research and development for improving the $Ni_3Si$ intermetallic compounds has been promoted.

For example, an $Ni_3$(Si, Ti)-based intermetallic compound, which is a nickel intermetallic compound, is known as a workable (ductile) intermetallic compound (see Non-Patent Document 1, for example).

In regard to such an $Ni_3$(Si, Ti)-based intermetallic compound, for example, a method for producing a foil of an $Ni_3$(Si, Ti)-based intermetallic compound composed of Ni, Si, Ti and B is known, and it is known that the foil of the $Ni_3$(Si, Ti)-based intermetallic compound produced according to this method has enhanced strength characteristics in a range of temperature from room temperature to 600° C. (see Patent Document 1, for example). The $Ni_3$(Si, Ti)-based intermetallic compound is expected to be applied to catalyst carriers for automobile exhaust control systems and aircraft structural materials, for example.

In addition, an $Ni_3$(Si, Ti)-based intermetallic compound containing specified amounts of Nb and Cr is known as an $Ni_3$(Si, Ti)-based intermetallic compound enabled for plastic working, and it is known that the $Ni_3$(Si, Ti)-based intermetallic compound can be easily worked into a foil (see Patent Document 2, for example).

Furthermore, $Ni_3$(Si, Ti)-based intermetallic compounds containing Ni, Si, Ti and Cu are known as $Ni_3$(Si, Ti)-based intermetallic compounds having ductility, though their workability into a foil is not known (see Patent Documents 3 and 4, for example). Besides, an Ni-based superalloy to which high-concentration Co and Ti are added is known, though it is not an $Ni_3$(Si, Ti)-based intermetallic compound (see Patent Document 5, for example). This alloy has a gamma prime phase including $(Ni/Co)_3(Al/Ti/Ta)$.

RELATED ART DOCUMENTS

Non-Patent Documents

Non-Patent Document 1: T. Takasugi et al., Journal of Materials Science 26. pp. 1173-1178 (1991)

Patent Documents

Patent Document 1: Japanese Unexamined Patent Publication No. 2007-84903

Patent Document 2: Japanese Unexamined Patent Publication No. 2008-266754

Patent Document 3: Japanese Unexamined Patent Publication No. HEI 4 (1992)-246144

Patent Document 4: Japanese Unexamined Patent Publication No. HEI 5 (1993)-320794

Patent Document 5: Japanese Unexamined Patent Publication No. 2009-97094

SUMMARY OF THE INVENTION

Problems to be Solved by the Invention

However, conventional $Ni_3$(Si, Ti)-based intermetallic compounds have not been sufficiently considered for mechanical characteristics, for example, mechanical characteristics after plastic working (such as strength and ductility of a foil produced by rolling). Even in the case of $Ni_3$(Si, Ti)-based intermetallic compounds that have been sufficiently considered for mechanical characteristics, the ductility is gradually reduced when a foil produced by rolling is subjected to a high temperature, for example, and an expensive metal (for example, Nb) is added in order to enhance the ductility at high temperatures and the oxidation resistance. It is therefore desired to sufficiently consider an $Ni_3$(Si, Ti)-based intermetallic compound for mechanical characteristics and enhance the $Ni_3$(Si, Ti)-based intermetallic compound in ductility at high temperatures. Furthermore, an $Ni_3$(Si, Ti)-based intermetallic compound that can be formed with relatively inexpensive metals is desired.

The present invention provides an $Ni_3$(Si, Ti)-based intermetallic compound having enhanced ductility at high temperatures and more enhanced strength characteristics.

Means for Solving the Problems

The present invention provides an $Ni_3$(Si, Ti)-based intermetallic compound characterized by containing from 25 to 500 ppm by weight of B with respect to a weight of an intermetallic compound having a composition of 100% by atom in total consisting of Ni as a main component, from 7.5 to 12.5% by atom of Si, from 4.5 to 11.5% by atom of Ti and from 0.5 to 5.0% by atom of W.

Effects of the Invention

The inventors of the present invention have originated addition of a high melting point metal element in place of Ti in $Ni_3$(Si, Ti) and made intensive studies. As a result, the inventors of the present invention have found that an $Ni_3$(Si, Ti)-based intermetallic compound containing W in addition to Ni, Si, Ti and B has excellent ductility characteristics in a range of temperature from room temperature to high temperatures to reach completion of the present invention. Having excellent ductility characteristics at high temperatures in particular, the intermetallic compound of the present invention can be plastically worked at high temperatures. Accordingly, the intermetallic compound of the present invention can be worked into a desired shape in fewer steps. In addition, the intermetallic compound of the present invention has ductility at high temperatures to prevent rapid progress of metal fracture at high temperatures.

In addition, the $Ni_3$(Si, Ti)-based intermetallic compound of the present invention can be easily worked into a foil or a sheet (hereinafter, also referred to as foil), and the foil has excellent ductility and strength. The $Ni_3$(Si, Ti)-based intermetallic compound of the present invention is therefore suitable for materials of foils.

In addition, since W, which is less expensive than Nb, is used in the $Ni_3$(Si, Ti)-based intermetallic compound of the present invention, the material cost is relatively low.

Further, the inventors of the present invention have found that the intermetallic compound of the present invention has superior strength characteristics to the $Ni_3$(Si, Ti)-based intermetallic compound disclosed in Patent Document 1, which is composed of Ni, Si, Ti and B.

MODE FOR CARRYING OUT THE INVENTION

Figure 1:
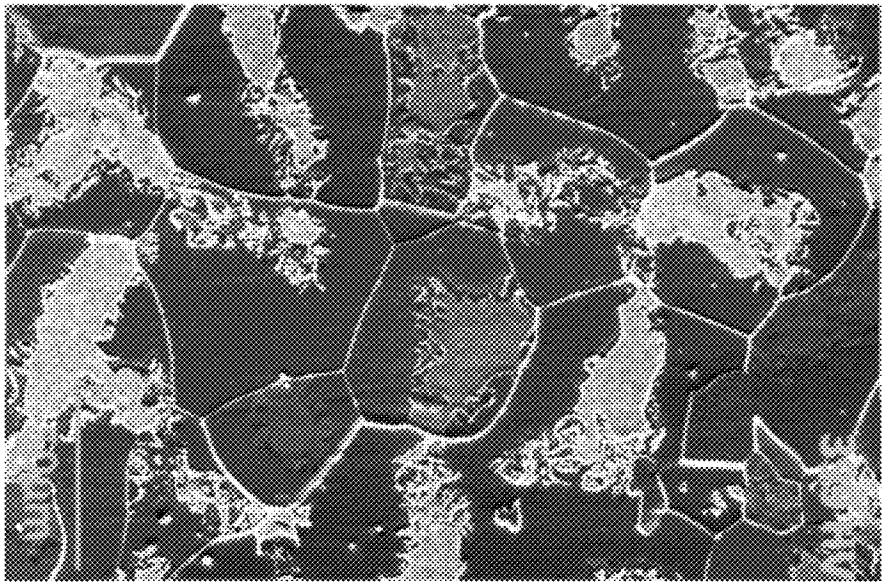
FIG. 1 is an SEM photograph of Example Sample 1.

According to an aspect, an $Ni_3$(Si, Ti)-based intermetallic compound of the present invention is characterized by containing an intermetallic compound having a composition of 100% by atom in total consisting of Ni as a main component, from 7.5 to 12.5% by atom of Si, from 4.5 to 11.5% by atom of Ti and from 0.5 to 5.0% by atom of W, and from 25 to 500 ppm by weight of B with respect to the weight of the intermetallic compound.

First, various embodiments of the present invention will be exemplified. In this specification, "from A to B" means that numerical values A and B are included in the range. In this specification, in addition, an intermetallic compound based on a composition of $Ni_3$(Si, Ti) is referred to as "$Ni_3$(Si, Ti)-based intermetallic compound".

According to an embodiment of the present invention, in addition to the above-described configuration of the invention, the intermetallic compound may comprise an $L1_2$ phase and an Ni solid solution phase.

According to an embodiment of the present invention, the intermetallic compound preferably contains an intermetallic compound having a composition of 100% by atom in total consisting of Ni as a main component, from 7.5 to 12.5% by atom of Si, from 5.5 to 11.5% by atom of Ti and from 0.5 to 4.0% by atom of W, and from 25 to 500 ppm by weight of B with respect to the weight of the intermetallic compound. More preferably, the intermetallic compound contains an intermetallic compound having a composition of 100% by atom in total consisting of Ni as a main component, from 10.0 to 12.0% by atom of Si, from 6.5 to 10.5% by atom of Ti and from 1.0 to 3.0% by atom of W, and from 25 to 100 ppm by weight of B with respect to the weight of the intermetallic compound. Furthermore, the intermetallic compound according to the embodiments may comprise an $L1_2$ phase and an Ni solid solution phase.

Alternatively, according to an embodiment of the present invention, the intermetallic compound may contain an intermetallic compound having a composition of 100% by atom in total consisting of Ni as a main component, from 10.0 to 12.0% by atom of Si, from 9.5 to 12.0% by atom of Ti and from 9.5 to 12.0% by atom of W, and from 25 to 100 ppm by weight of B with respect to the weight of the intermetallic compound. In this embodiment, the intermetallic compound preferably contains from 5.5 to 11.5% by atom of Ti and from 0.5 to 4.0% by atom of W, and more preferably contains from 6.5 to 10.5% by atom of Ti and from 1.0 to 3.0% by atom of W.

According to an embodiment of the present invention, the intermetallic compound may be obtained through cold rolling at a rolling reduction of 85-99%. Such cold rolling allows production of an intermetallic compound having excellent strength (for example, tensile strength).

According to an embodiment of the present invention, the intermetallic compound may be obtained through annealing at 300-1050° C. performed after the cold rolling. The annealing may be performed at from 650 to 1050° C.; the annealing performed at a temperature of 650° C. or more allows production of an intermetallic compound having excellent ductility.

The present invention also provides a rolled foil of the $Ni_3$(Si, Ti)-based intermetallic compound according to the invention, the foil having a thickness of 20-300 μm. According to the present invention, the rolled foil of the $Ni_3$(Si, Ti)-based intermetallic compound having excellent ductility characteristics can be produced. Here, the rolled foil includes a rolled sheet, and the rolled foil obtained by the cold rolling or the rolled foil obtained by the cold rolling and the annealing has excellent ductility and strength.

According to another aspect, the present invention provides a method for producing a rolled sheet or foil of an $Ni_3$(Si, Ti)-based intermetallic compound, the method comprising: an ingot preparation step of preparing an ingot containing an intermetallic compound having a composition of 100% by atom in total consisting of Ni as a main component, from 7.5 to 12.5% by atom of Si, from 4.5 to 11.5% by atom of Ti and from 0.5 to 5.0% by atom of W, and from 25 to 500 ppm by weight of B with respect to the weight of the intermetallic compound; a homogenization heat treatment step of performing homogenization heat treatment on the ingot; a thermomechanical heat treatment step of repeating rolling at a rolling reduction of 10% or more and annealing at 900-1100° C. on the ingot after the homogenization heat treatment step three times or more to prepare a sheet material; and a cold rolling step of performing cold rolling on the sheet material at a rolling reduction of 85-99%.

In the method for producing a rolled sheet or foil of an intermetallic compound of the present invention, the rolling in the thermomechanical heat treatment step may be cold rolling or warm rolling at 350° C. or lower. Furthermore, the rolling in the thermomechanical heat treatment step may be warm rolling at 250-350° C.

The various embodiments shown herein may be combined with one another.

[Content of Each Element]

Next, the content of each element will be described.

The content of Ni is, for example, from 78.5 to 81.0% by atom, and preferably from 78.5 to 80.5% by atom. Specific examples of the content of Ni include 78.5, 79.0, 79.5, 80.0, 80.5 and 81.0% by atom. The content of Ni may be between any two of the numeral values exemplified here.

The content of Si is from 7.5 to 12.5% by atom, and preferably from 10.0 to 12.0% by atom. Specific examples of the content of Si include 7.5, 8.0, 8.5, 9.0, 9.5, 10.0, 10.5, 11.0, 11.5, 12.0 and 12.5% by atom. The content of Si may be between any two of the numeral values exemplified here.

The content of Ti is from 4.5 to 11.5% by atom, preferably from 5.5 to 11.5% by atom, and more preferably from 6.5 to 10.5% by atom. Specific examples of the content of Ti include 4.5, 5.0, 5.5, 6.0, 6.5, 7.0, 7.5, 8.0, 8.5, 9.0, 9.5, 10.0, 10.5, 11.0 and 11.5% by atom. The content of Ti may be between any two of the numeral values exemplified here.

The content of W is from 0.5 to 5.0% by atom, preferably from 0.5 to 4.0% by atom, and more preferably from 1.0 to 3.0% by atom. Specific examples of the content of W include 0.5, 1.0, 1.5, 2.0, 2.5, 3.0, 3.5, 4.0, 4.5 and 5.0% by atom. The content of W may be between any two of the numeral values exemplified here.

The content of each element is adjusted appropriately so that the total content of Ni, Si, Ti and W is 100% by atom.

The content of B is from 25 to 500 ppm by weight and preferably from 25 to 100 ppm by weight. Specific examples of the content of B include 25, 40, 50, 60, 75, 100, 150, 200, 300, 400 and 500 ppm by weight. The content of B may be between any two of the numeral values exemplified here.

According to an embodiment of the present invention, specific compositions of the intermetallic compound are obtained by adding the above-mentioned content of B to the compositions shown in Tables 1-3, for example.

TABLE 1

| Ni atomic % | Si atomic % | Ti atomic % | W atomic % |
|---|---|---|---|
| 78.5 | 8.0 | 11.5 | 2.0 |
| 78.5 | 8.0 | 10.5 | 3.0 |
| 78.5 | 8.0 | 9.5 | 4.0 |
| 78.5 | 9.5 | 11.0 | 1.0 |
| 78.5 | 9.5 | 10.0 | 2.0 |
| 78.5 | 9.5 | 9.0 | 3.0 |

TABLE 1-continued

| Ni atomic % | Si atomic % | Ti atomic % | W atomic % |
|---|---|---|---|
| 78.5 | 9.5 | 8.0 | 4.0 |
| 78.5 | 11.0 | 10.0 | 0.5 |
| 78.5 | 11.0 | 9.0 | 1.5 |
| 78.5 | 11.0 | 8.0 | 2.5 |
| 78.5 | 12.5 | 8.5 | 0.5 |
| 78.5 | 12.5 | 7.5 | 1.5 |
| 78.5 | 12.5 | 6.5 | 2.5 |
| 78.5 | 12.0 | 5.0 | 4.5 |
| 78.5 | 12.0 | 4.5 | 5.0 |

TABLE 2

| Ni atomic % | Si atomic % | Ti atomic % | W atomic % |
|---|---|---|---|
| 79.5 | 8.0 | 11.5 | 1.0 |
| 79.5 | 8.0 | 10.5 | 2.0 |
| 79.5 | 9.5 | 10.0 | 1.0 |
| 79.5 | 9.5 | 9.0 | 2.0 |
| 79.5 | 9.5 | 8.0 | 3.0 |
| 79.5 | 9.5 | 7.0 | 4.0 |
| 79.5 | 11.0 | 9.0 | 0.5 |
| 79.5 | 11.0 | 8.5 | 1.0 |
| 79.5 | 11.0 | 7.5 | 2.0 |
| 79.5 | 11.0 | 6.5 | 3.0 |
| 79.5 | 11.0 | 5.5 | 4.0 |
| 79.5 | 12.5 | 7.0 | 1.0 |
| 79.5 | 12.5 | 6.0 | 2.0 |
| 79.5 | 12.5 | 7.5 | 0.5 |
| 79.5 | 11.0 | 5.0 | 4.5 |
| 79.5 | 11.0 | 4.5 | 5.0 |

TABLE 3

| Ni atomic % | Si atomic % | Ti atomic % | W atomic % |
|---|---|---|---|
| 81.0 | 7.5 | 10.5 | 1.0 |
| 81.0 | 8.0 | 10.0 | 1.0 |
| 81.0 | 8.0 | 9.0 | 2.0 |
| 81.0 | 8.0 | 8.0 | 3.0 |
| 81.0 | 8.0 | 7.0 | 4.0 |
| 81.0 | 9.5 | 8.5 | 1.0 |
| 81.0 | 9.5 | 7.5 | 2.0 |
| 81.0 | 9.5 | 6.5 | 3.0 |
| 81.0 | 9.5 | 5.5 | 4.0 |
| 81.0 | 11.0 | 7.0 | 1.0 |
| 81.0 | 11.0 | 6.0 | 2.0 |
| 81.0 | 11.0 | 5.5 | 2.5 |
| 81.0 | 12.5 | 5.5 | 1.0 |
| 81.0 | 9.5 | 5.0 | 4.5 |
| 81.0 | 9.5 | 4.5 | 5.0 |

[Rolled Sheet or Foil and Method for Producing the Same]

Next, a rolled sheet or foil of an $Ni_3$(Si, Ti)-based intermetallic compound will be described.

The rolled sheet or foil of an $Ni_3$(Si, Ti)-based intermetallic compound is obtained by forming an $Ni_3$(Si, Ti)-based intermetallic compound having a composition of the embodiment into a sheet or a foil. Though not particularly limited, the thickness of the rolled sheet or foil of an $Ni_3$(Si, Ti)-based intermetallic compound is, for example, 10 μm-10 mm, preferably 10-1000 μm, and more preferably 20-300 μm. Hereinafter, production steps of the rolled sheet or foil will be described.

(1) Ingot Preparation Step

First, an ingot having a composition mentioned in the embodiment is prepared. For example, the ingot can be obtained by weighing appropriate amounts of Ni, Si, Ti, W and B to compose an $Ni_3$(Si, Ti)-based intermetallic compound having a composition of the embodiment, heating and melting the components in a melting furnace, and pouring the resulting molten metal into a mold for casting. The melting furnace is not particularly limited as long as it can melt such metals, and usable examples thereof include a vacuum induction melting furnace and an arc melting furnace.

(2) Homogenization Heat Treatment Step

Homogenization heat treatment is performed on the ingot obtained in the ingot preparation step. The homogenization heat treatment renders the elements in the ingot free from segregation, so that the composition of the whole ingot can be homogeneous and uniform. In the homogenization heat treatment, the ingot was put in a vacuum and heat-treated at 950-1100° C. for 24-48 hours, for example.

(3) Thermomechanical Heat Treatment Step

Next, rolling and annealing is repeatedly performed on the ingot after the homogenization heat treatment to form the ingot into a sheet to obtain a sheet material. First, the ingot given the homogenization heat treatment is rolled into a sheet material. After the rolling, annealing is performed to eliminate work-hardening, and then rolling is further performed. The rolling and the annealing are performed repeatedly to form the ingot into a sheet material having a desired thickness.

The rolling process is not particularly limited; for example, a sample can be caused to pass through a rolling machine to be rolled. For example, when the material is rolled with a rolling machine, it is preferable that the rolling is performed at a rolling reduction of 0.5-1.5% per pass and 10-20 passes of rolling is performed. Such rolling with a rolling machine is repeated so that the rolling reduction of the entire rolling process is 10% or more, preferably 10-50%, and more preferably 15-30%. In this specification, the "rolling reduction" means a total thickness reduction by a plurality of passes of rolling, unless stated clearly with "per pass".

The rolling temperature is not particularly limited; the rolling may be cold rolling or warm rolling. While cold rolling is acceptable, warm rolling at a temperature of 350° C. or less (preferably, 250-350° C.) is desirable in this embodiment. It is thereby possible to reduce the number of times of annealing, if any, to be performed after the rolling. Ordinary metals are more workable at a higher rolling temperature, whereas the $Ni_3$(Si, Ti)-based intermetallic compound prefers warm rolling at a temperature of 350° C. or less (more preferably, 250-350° C.), because it has yield strength showing inverse temperature dependency and therefore becomes less deformable when the temperature is raised.

The annealing can be performed under any condition as long as it can eliminate work-hardening of the sample. In the annealing, the material is retained in a vacuum at 900-1100° C. for 1-5 hours, for example.

The rolling and the annealing are repeated until a sheet material having a desired thickness is obtained. Specifically, the rolling and the annealing are repeated three times or more, and preferably four times or more.

(4) Full Annealing Step

Full annealing may be performed on the sheet material given the thermomechanical heat treatment. The full annealing can eliminate the internal stress of the sheet material given the thermomechanical heat treatment. The full annealing is therefore preferable as a treatment prior to the cold rolling to be described next. In the full annealing, the sheet material is put in a vacuum and heat-treated at 900-1050° C. for 0.5-5 hours, for example.

(5) Cold Rolling Step

Next, cold rolling is performed on the sheet material at a rolling reduction of 85-99%. As a result of the cold rolling, a desired rolled sheet or foil of an $Ni_3$(Si, Ti)-based intermetallic compound is obtained. The cold rolling process is not particularly limited; for example, the sheet material can be caused to pass through a rolling machine to be cold-rolled.

When one-time cold rolling is insufficient for obtaining a foil having a desired thickness, annealing may be performed after the cold rolling, and then cold rolling may be performed again to further reduce the thickness. In the annealing, the material is retained in a vacuum at 800-1000° C. for 0.5-2 hours, for example.

In addition, the strength characteristics of the sample can be enhanced by work-hardening due to the cold rolling. The rolled sheet or foil of an $Ni_3$(Si, Ti)-based intermetallic compound after the cold rolling therefore has very high strength characteristics and can be used as a structural material.

(6) Annealing Step

Annealing can be performed on the rolled sheet or foil of an $Ni_3$(Si, Ti)-based intermetallic compound obtained in the cold rolling step. The annealing is performed in a vacuum at 100-1050° C. The annealing time is 0.5-2 hours, for example. The annealing step enhances the ductility characteristics of the sheet or the foil. In addition, when the sheet or the foil is used at a temperature of 100-700° C., the annealing at a temperature equal to or higher than the use temperature can stabilize the characteristics of the sheet or the foil.

[Demonstration Experiment 1]

Next, an effect demonstration experiment for verifying the effect of the present invention will be described. In the effect demonstration experiment, Demonstration Experiment 1 for studying the characteristics of the target intermetallic compound was performed. Hereinafter, Demonstration Experiment 1 will be described.

(Sample Preparation)

(1) Ingot Sample Preparation Step

Table 4 shows the composition of an intermetallic compound prepared in Demonstration Experiment 1 and the composition of an intermetallic compound prepared for comparison, which is disclosed in Patent Document 1.

TABLE 4

| | Ni at. % | Si at. % | Ti at. % | W at. % | B wt. ppm | Remarks: Shortened sample name |
|---|---|---|---|---|---|---|
| Comparative Example Sample | 79.5 | 11.0 | 9.5 | — | 50 | $Ni_3$(Si,Ti) |
| Example Sample 1 | 79.5 | 11.0 | 7.5 | 2.0 | 50 | $Ni_3$(Si,Ti) + 2W or 2W |

First, the respective metals (purity of each metal: 99.9% by weight or more) and B were weighted so as to form the two kinds of compositions shown in Table 4. Subsequently, the weighted metals and B were melted in an arc melting furnace and casted to prepare ingots each having a thickness of 10 mm or more. A melting chamber of the arc melting furnace was evacuated, and the atmosphere in the arc melting furnace is replaced with an inert gas (argon gas). Non-consumable tungsten electrodes were employed as electrodes of the furnace, and a water-cooling copper hearth was employed as a mold.

A sample containing 2.0 atomic % of W is an example of the present invention, which hereinafter is referred to as "Example Sample 1". On the other hand, a sample not containing W is referred to as "Comparative Example Sample", which may be simply referred to as "$Ni_3(Si, Ti)$" in the drawings, meaning that it consists only of the basic composition.

(2) Homogenization Heat Treatment Step

Subsequently, a homogenization heat treatment step was performed in which each ingot was retained in a vacuum at 1050° C. for 48 hours for homogenization. The ingot obtained through the homogenization heat treatment is referred to as "homogenization heat-treated ingot".

(3) Warm Rolling Step

Subsequently, the homogenization heat-treated ingot was cut into a thickness of 10 mm, and warm rolling and annealing process was repeated on the cut ingot five times to prepare a sheet material having a thickness of 2 mm. In the warm rolling, the sample was heated up to 300° C. in the atmosphere and subjected to 10-20 passes of rolling by using a 2-high rolling machine, provided that the rolling reduction was approximately 0.1 mm per pass. In addition, the sample was heated for each pass.

In the annealing process, the sample was retained in a vacuum at 1000° C. for 5 hours.

(4) Full Annealing Step

Subsequently, full annealing was performed in which the sheet material was retained in a vacuum at 1050° C. for 1 hour.

(5) Cold Rolling Step

Subsequently, cold rolling was performed on the sheet material obtained in the preceding step at room temperature to prepare a foil. The cold rolling was performed at a rolling reduction of 90%, during which annealing was not performed. The cold rolling process was performed by using a dies steel roll until the thickness of the sheet material reached approximately 0.5 mm, and then performed by using a carbide roll. The same 2-high rolling machine was used for both the dies steel roll and the carbide roll. The thickness of the foil prepared was 0.2 mm. Hereinafter, such a foil obtained by cold rolling without annealing after the cold rolling is referred to as "cold-rolled foil".

(6) Annealing Step

Subsequently, the cold-rolled foil obtained in the preceding step was retained in a vacuum at 500, 600, 700, 800, 900 or 1000° C. for 1 hour for annealing. Hereinafter, the term "annealing" means annealing after the cold rolling, unless otherwise stated.

As described above, the sample was prepared.

(Sample Evaluation)

(1) Microstructure Observation

Microstructure observation was performed on the sample obtained after the homogenization heat treatment step (Example Sample 1). Specifically, an SEM photograph of the microstructure of the homogenization heat-treated ingot (Example Sample 1) was taken. FIG. 1 shows the photograph.

FIG. 1 reveals that Example Sample 1 has a two-phase microstructure. Specifically, Example Sample 1 has a two-phase microstructure composed of a parent phase (matrix) and a second phase formed in the parent phase. Example Sample 1 had a Vickers' hardness of 399 HV.

Figure 2:
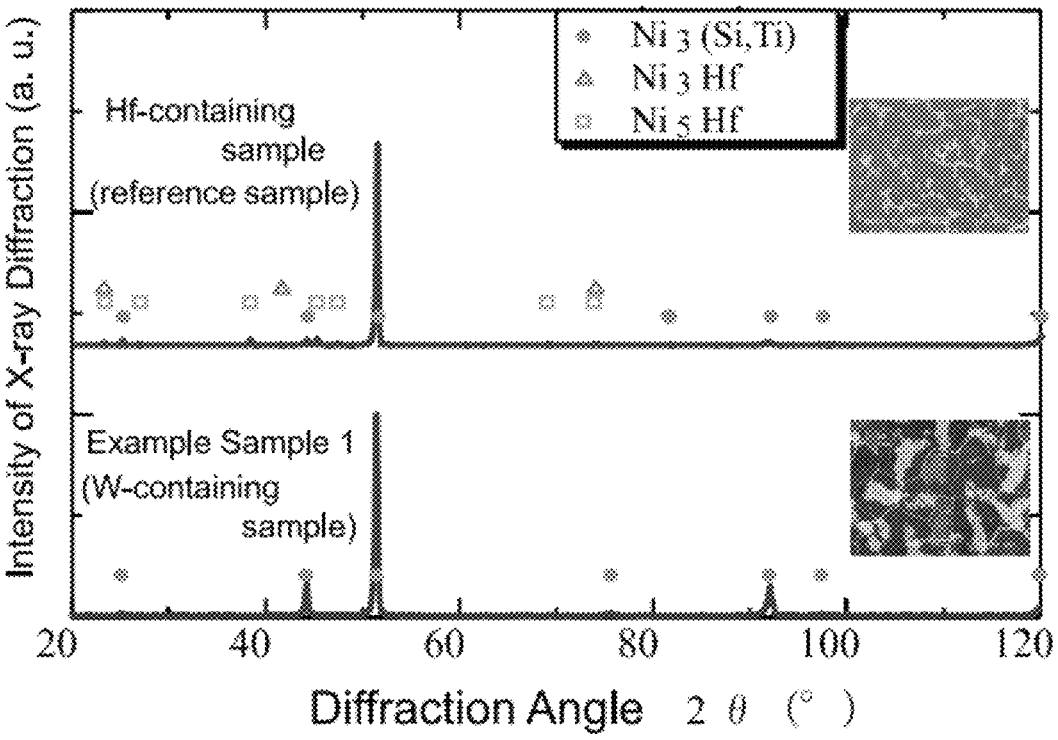
FIG. 2 shows an X-ray diffraction profile of Example Sample 1. The upper is an X-ray diffraction profile of an Hf-containing sample (reference sample), and the lower is the X-ray diffraction profile of a W-containing sample (Example Sample 1).

Further, an X-ray diffraction measurement was performed on the homogenization heat-treated ingot (Example Sample 1) in order to identify the constituent phases in the microstructure. FIG. 2 shows the measurement result. FIG. 2 shows an X-ray diffraction profile of Example Sample 1. For reference, an X-ray diffraction profile of $Ni_{77.5}Si_{11.0}Ti_{9.5}Hf_{2.0}$+50 wt ppm of B (represented by atomic % except for B; hereinafter, referred to as "Hf-containing sample") is shown together. The upper is the X-ray diffraction profile of the Hf-containing sample (reference sample), and the lower is the X-ray diffraction profile of Example Sample 1. The dots in the drawing represent peak positions of profiles of known materials, that is, $Ni_3(Si, Ti)$ (Comparative Example sample), $Ni_3Hf$ and $Ni_5Hf$. The Hf-containing sample shown here was prepared by the same method as in Example Sample 1 (ingot sample preparation step and homogenization heat treatment step).

FIG. 2 reveals that the X-ray diffraction profile of Example Sample 1 agrees with the profile of $Ni_3(Si, Ti)$ in peak positions. Based on the facts that Example Sample 1 has a two-phase microstructure confirmed by the previously-shown SEM photograph (FIG. 1) and that diffraction lines from the fcc-Ni solid solution phase and the $L1_2$ phase overlap to be inseparable in the X-ray diffraction profile, the two-phase microstructure of Example Sample 1 can be identified to be an $Ni_3(Si, Ti)$ phase having an $L1_2$ crystal structure and an Ni solid solution phase having a face-centered cubic (fcc) structure (hereinafter, also referred to as fcc-Ni solid solution phase). Since the $Ni_3(Si, Ti)$ of Comparative Example Sample has a single phase microstructure of an $L1_2$ phase, it is revealed that the parent phase (matrix) is the $L1_2$ phase and the second phase is the fcc-Ni solid solution phase.

Figure 3:
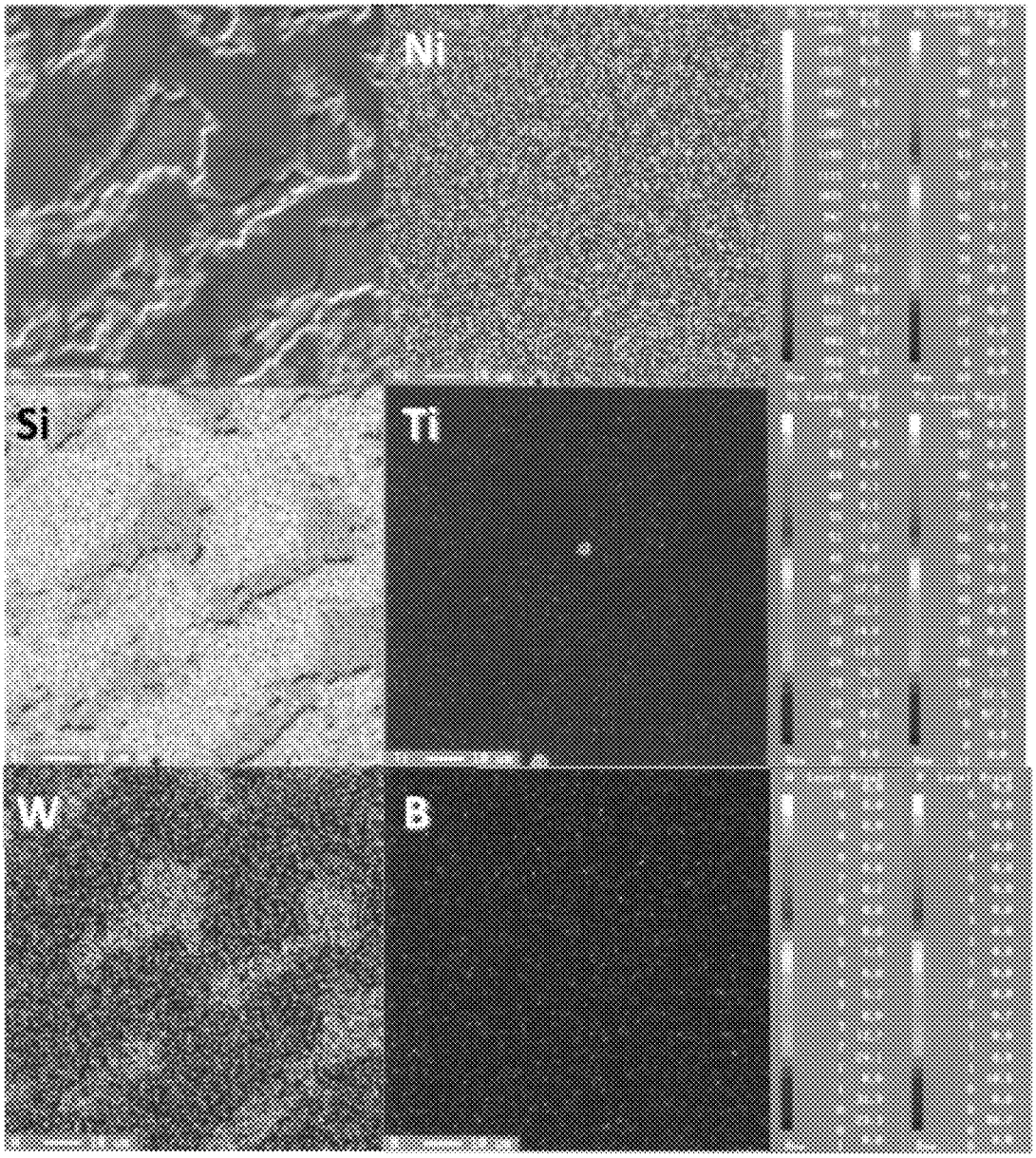
FIG. 3 shows element maps of Example Sample 1 according to EPMA.

Further, EPMA was performed on Example Sample 1 for microstructure analysis. FIG. 3 shows the analysis result. FIG. 3 shows element maps of Example Sample 1 according to the EPMA. In FIG. 3, the upper left image is an SEM photograph, the upper right image is a map of Ni, the center left image is a map of Si, the center right image is a map of Ti, the lower left image is a map of W, and the lower right image is a map of B.

As shown in FIG. 3, it is revealed that Ni, Ti and B are distributed uniformly all over the microstructure according to their element maps, whereas Si and W each have different element concentrations between the two phases in the structure according to their element maps. In the EPMA, point analysis was performed (point analysis was performed for each of the two phases) to find that the fcc-Ni solid solution phase (second phase) has a lower Si concentration and a higher W concentration than the $L1_2$ phase (matrix) as shown in Table 5.

TABLE 5

| | Ni atomic % | Si atomic % | Ti atomic % | W atomic % | B atomic % |
|---|---|---|---|---|---|
| Matrix | 78.0 | 12.2 | 8.3 | 1.0 | 0.5 |
| Second Phase | 81.6 | 9.2 | 6.9 | 2.3 | 0.0 |

(2) Vickers' Hardness Test

Next, a Vickers' hardness test was performed on (i) homogenization heat-treated ingot (Example Sample 1), (ii) cold-rolled foil (Example Sample 1) and (iii) cold-rolled foil subjected to annealing at each temperature (Example Sample 1). In the Vickers' hardness test, a square pyramid diamond indenter was pushed into each sample. The load was mainly 300 g, and the retention time was 20 seconds.

Figure 4:
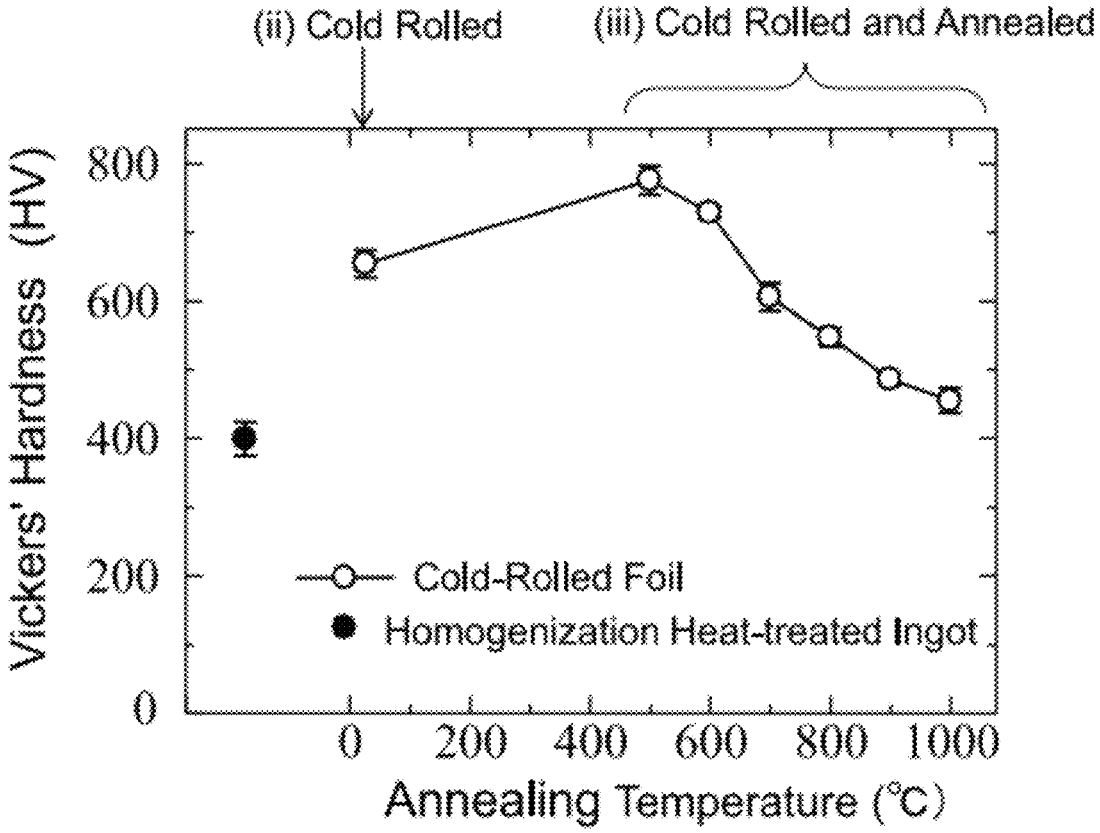
FIG. 4 is a diagram showing results of a Vickers' hardness test in Demonstration Experiment 1 of the present invention, that is, a graph showing the relationship between the annealing temperature and the Vickers' hardness of each sample.

FIG. 4 shows the test results. FIG. 4 is a diagram showing the results of the Vickers' hardness test, that is, a graph showing the relationship between the annealing temperature and the Vickers' hardness of each sample. In FIG. 4, the leftmost dot represents characteristics of (i) homogenization heat-treated ingot, and the dots connected with a solid line represent characteristics of (ii) cold-rolled foil and (iii) cold-rolled foil subjected to annealing at each temperature (Example Sample 1). The dot around room temperature out of the dots connected with the solid line represents characteristics of (ii) cold-rolled foil.

FIG. 4 indicates that the intermetallic compound of Example Sample 1 shows a high value exceeding 600 HV when subjected to the cold rolling step. It is also indicated that the value of the Vickers' hardness is further increased by annealing performed at 500° C. or 600° C. It is further indicated that the cold-rolled foil is softened due to recrystallization by annealing performed at a temperature of approximately 700° C., but still harder than the homogenization heat-treated ingot even subjected to annealing at 1000° C. It is inferred because the microstructure became finer because of the processing treatment including the cold rolling.

(3) Room-Temperature Tensile Test

Next, a room-temperature tensile test was performed on (i) cold-rolled foil and (ii) cold-rolled foil subjected to annealing at each temperature of Example Sample 1 and Comparative Example Sample. The size of the samples used in the room-temperature tensile test was 10 mm in length of a parallel part and 4 mm in width. The room-temperature tensile test was performed in the atmosphere at room temperature and at a straining rate of $8.4\times10^{-5}$ $s^{-1}$.

Figure 5:
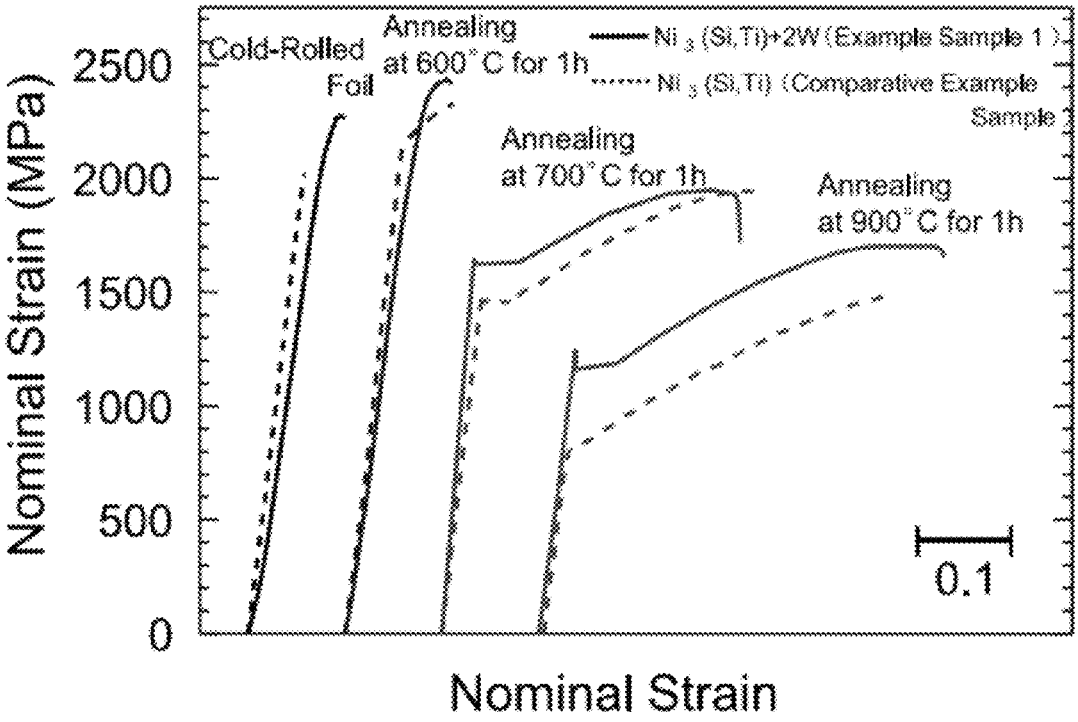
FIG. 5 is a diagram showing results of a room-temperature tensile test in Demonstration Experiment 1 of the present invention, that is, a graph showing the relationship between a stress added to Example Sample 1 and Comparative Example Sample, and strain generated in the samples in the room-temperature tensile test (nominal stress-nominal strain curve).
Figure 6:
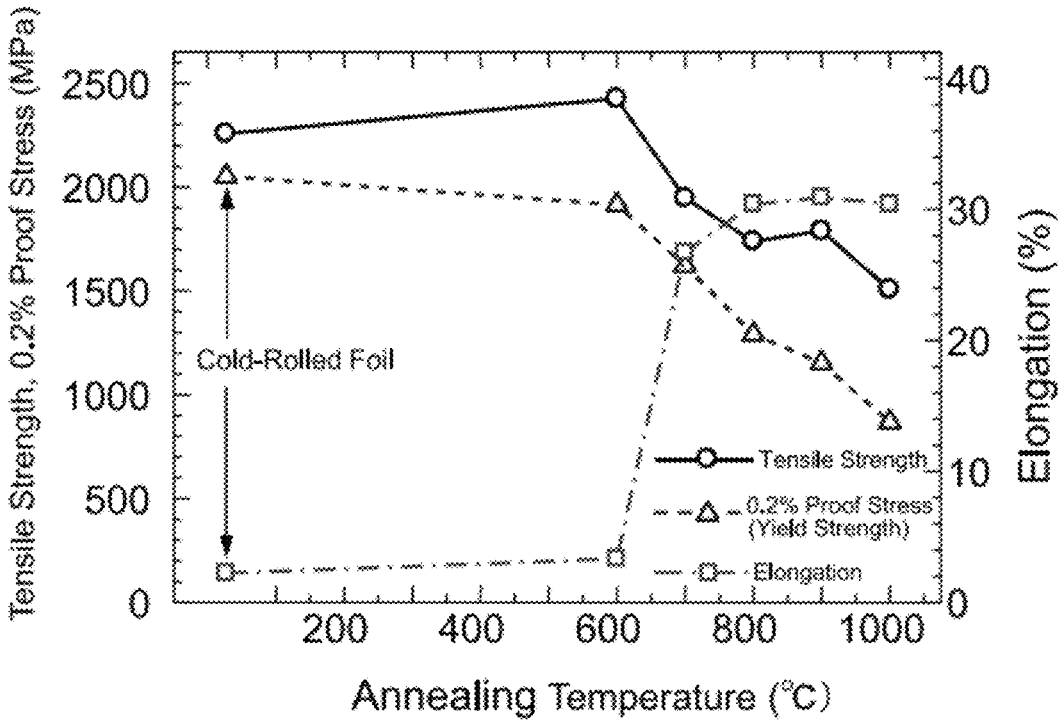
FIG. 6 is a diagram showing results of the room-temperature tensile test in Demonstration Experiment 1 of the present invention, that is, a graph showing the relationship of tensile strength, 0.2% proof stress (or yield strength) and elongation to annealing temperature of Example Sample 1.

FIGS. 5 and 6 show the test results. FIG. 5 is a graph showing the relationship between a stress added to Example Sample 1 and Comparative Example Sample, and strain generated in the samples in the room-temperature tensile test (nominal stress-nominal strain curve). FIG. 6 is a graph showing the relationship of tensile strength, 0.2% proof stress (or yield strength) and elongation to the annealing temperature of Example Sample 1. In FIG. 5, the cold-rolled foil represents data of the foils obtained without annealing (that is, (i) cold-rolled foil), and the numerical values in the graph represent annealing conditions. In FIG. 5, furthermore, the solid lines represent data of Example Sample 1, and the dotted lines represent data of Comparative Example Sample. The line at the lower right of FIG. 5 represents the magnitude of the nominal strain of 0.1, and the horizontal axis of FIG. 5 is based on this scale, starting from 0 at the left end. Likewise, the cold-rolled foil in FIG. 6 represents data of the foil obtained without annealing. In FIG. 6, the circular dots represent the tensile strength, the triangular dots represent the 0.2% proof stress (or yield strength), and the quadrangular dots represent the elongation.

FIG. 5 indicates that Example Sample 1 has more enhanced tensile strength and ductility than Comparative Example Sample. For example, Comparative Example Sample subjected to the annealing at 900° C. for 1 hour (900° C.-1 h annealing) has a tensile strength of 1480 MPa and a yield strength of 790 MPa, whereas Example Sample 1 subjected to the same annealing has greatly enhanced values, that is, a tensile strength of 1790 MPa and a yield strength of 1150 MPa. In addition, Example Sample 1 subjected to annealing at 600° C. for 1 hour has a tensile strength of more than 2400 MPa, indicating that Example Sample 1 has extremely high tensile strength characteristics. Possible reasons for Example Sample 1 to have higher tensile strength than Comparative Example Sample include an finer crystal grain size in the $L1_2$ matrix because of dispersion of the fcc-Ni solid solution phase and contribution to the enhancement by an interface between the $L1_2$ phase and the fcc-Ni solid solution phase.

Furthermore, FIG. 6 indicates that Example Sample 1 has reduced tensile strength and yield strength but considerably improved elongation when subjected to annealing at a temperature of more than 600° C. after the cold rolling. It is also indicated that when subjected to annealing at a temperature of more than 800° C., Example Sample 1 has an elongation (plastic elongation) reaching approximately 30%, having comparable ductility to conventional metals.

Figure 7:
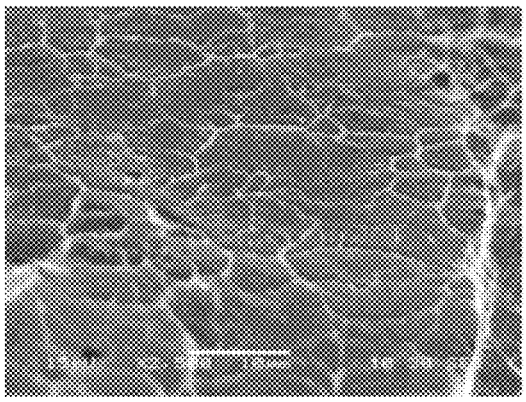
FIG. 7 shows SEM photographs of fracture surfaces of a cold-rolled foil (Example Sample 1) and cold-rolled foils subjected to annealing at temperatures of 600° C. and 900° C. (Example Sample 1) when subjected to the room-temperature tensile test.
Figure 7:
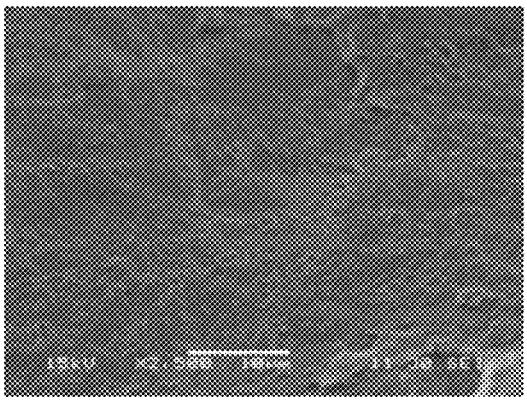
Figure 7:
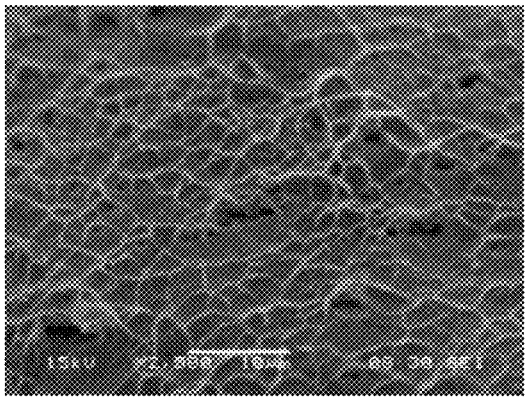

Subsequently, fracture surface observation was performed on Example Sample 1 after the tensile test to study its fracture form in the room-temperature tensile test. FIG. 7 shows SEM photographs of fracture surfaces of the cold-rolled foil (Example Sample 1) and the cold-rolled foils subjected to annealing at temperatures of 600° C. and 900° C. (Example Sample 1). In FIG. 7, (1) shows a fracture surface of the cold-rolled foil, (2) shows a fracture surface of the cold-rolled foil subjected to annealing at 600° C., and (3) shows a fracture surface of the cold-rolled foil subjected to annealing at 900° C., all of which are of Example Sample 1.

In FIG. 7, (1) to (3) indicate that the cold-rolled foil in (1) does not show such clear elongation in the tensile test as those shown in FIGS. 5 and 6. However, detailed observation has confirmed that the cold-rolled foil in (1) has a fracture surface having a shallow dimple pattern. In addition, dimples were observed in the fracture surfaces of Example Sample 1 in (2) and (3) in FIG. 7, confirming that the fracture surfaces are ductile. The results have revealed that Example Sample 1 has some ductility even as the cold-rolled foil.

(4) High-Temperature Tensile Test

Next, a tensile test was performed on Example Sample 1 and Comparative Example Sample, both subjected to annealing at 900° C. for 1 hour, at room temperature and high temperatures. The size of the foils used in the high-temperature tensile test was 10 mm in length of a parallel part and 4 mm in width. The high-temperature tensile test was performed in a vacuum at a straining rate of $8.4\times10^{-5}$ $s^{-1}$ from room temperature to 700° C.

Figure 8:
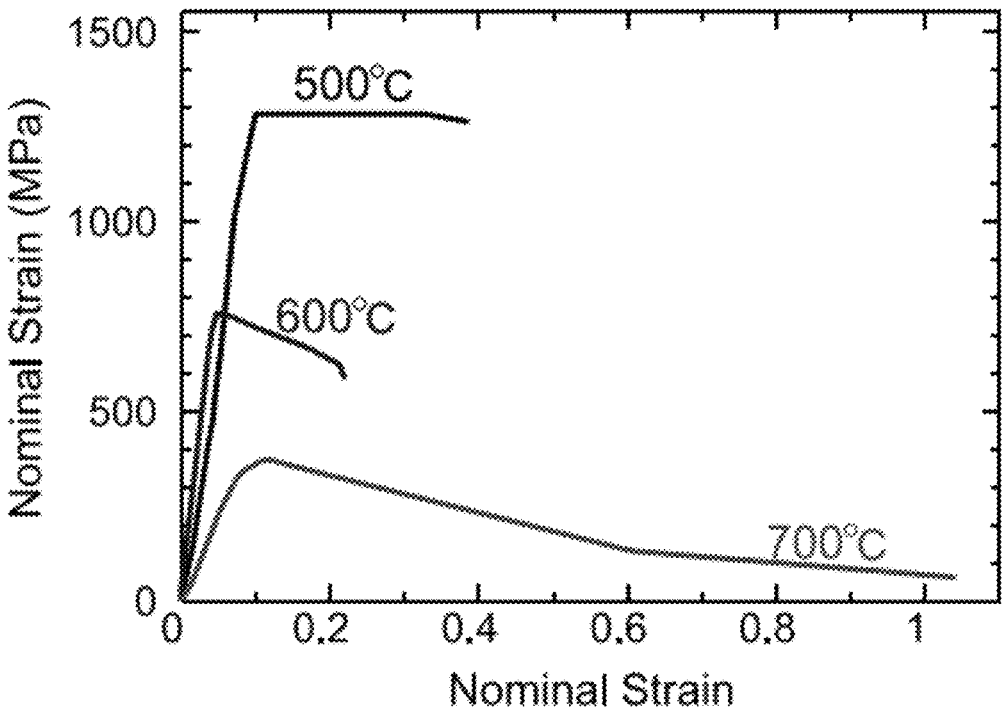
FIG. 8 is a diagram showing results of a high-temperature tensile test in Demonstration Experiment 1 of the present invention, that is, a graph showing the relationship between a stress added to Example Sample 1 and strain generated in the sample in the high-temperature tensile test (nominal stress-nominal strain curve).
Figure 9:
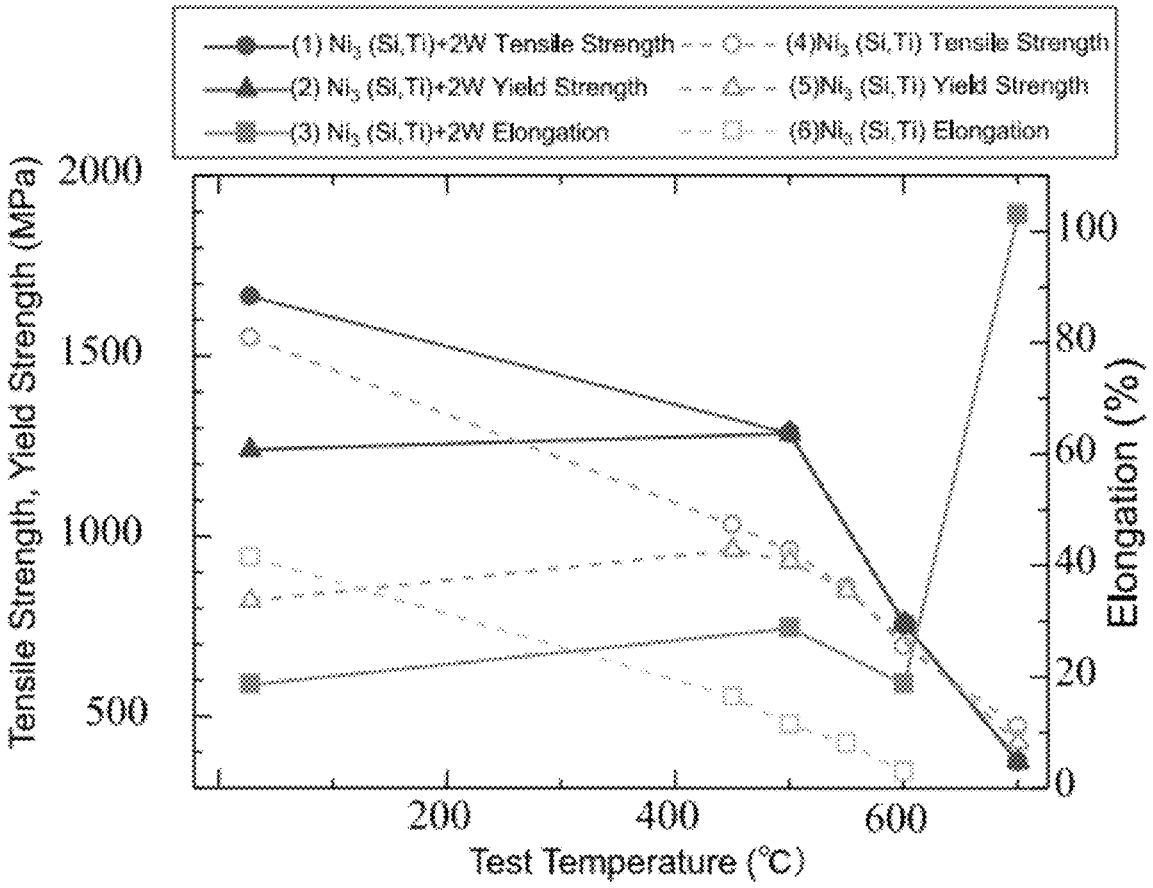
FIG. 9 is a diagram showing results of the high-temperature tensile test in Demonstration Experiment 1 of the present invention, that is, a graph showing the relationship of tensile strength, yield strength and elongation to test temperature of Example Sample 1 and Comparative Example Sample.

FIGS. 8 and 9 show the test results. FIG. 8 is a graph showing the relationship between a stress added to Example Sample 1 and strain generated in the sample in the high-temperature tensile test (nominal stress-nominal strain curve). FIG. 9 is a graph showing the relationship of tensile strength, yield strength and elongation to the test temperature of Example Sample 1 and Comparative Example Sample. The numerical values shown in FIG. 8 represent the test temperature. In addition, the solid lines in the graph of FIG. 9 ((1), (2) and (3) in FIG. 9) represent data of Example Sample 1, and the dotted lines in the graph of FIG. 9 ((4), (5) and (6) in FIG. 9) represent data of Comparative Example Sample. In FIG. 9, the circular dots represent the tensile strength, the triangular dots represent the yield strength, and the quadrangular dots represent the elongation.

FIG. 8 reveals that Example Sample 1 has a tensile strength of more than 1200 MPa at 500° C., indicating that Example Sample 1 has excellent tensile strength at high temperatures. It is also indicated that in Example Sample 1, the tensile strength is reduced as the test temperature is raised, but the elongation is improved even at high temperatures, showing excellent ductility at 700° C. in particular.

Next, FIG. 9 reveals that Example Sample 1 shows values indicating superior characteristics of tensile strength and yield stress, and elongation to the characteristics of the Comparative Example Sample. More particularly, it is revealed that Example Sample 1 shows higher values of tensile strength and yield stress than Comparative Example Sample at temperatures up to 600° C. In addition, in Comparative Example Sample, the elongation is reduced as the temperature is raised, and the elongation is almost lost at 600° C. On the other hand, in Example Sample 1, the elongation is not lost even at 600° C., and the value of the elongation is better than that of Comparative Example Sample at high temperatures. Supposedly, the data at 600° C. was achieved because grain boundary fracture, which occurs at high temperatures, was inhibited. Furthermore, Example Sample 1 has an elongation of more than 100% at 700° C.

Figure 10:
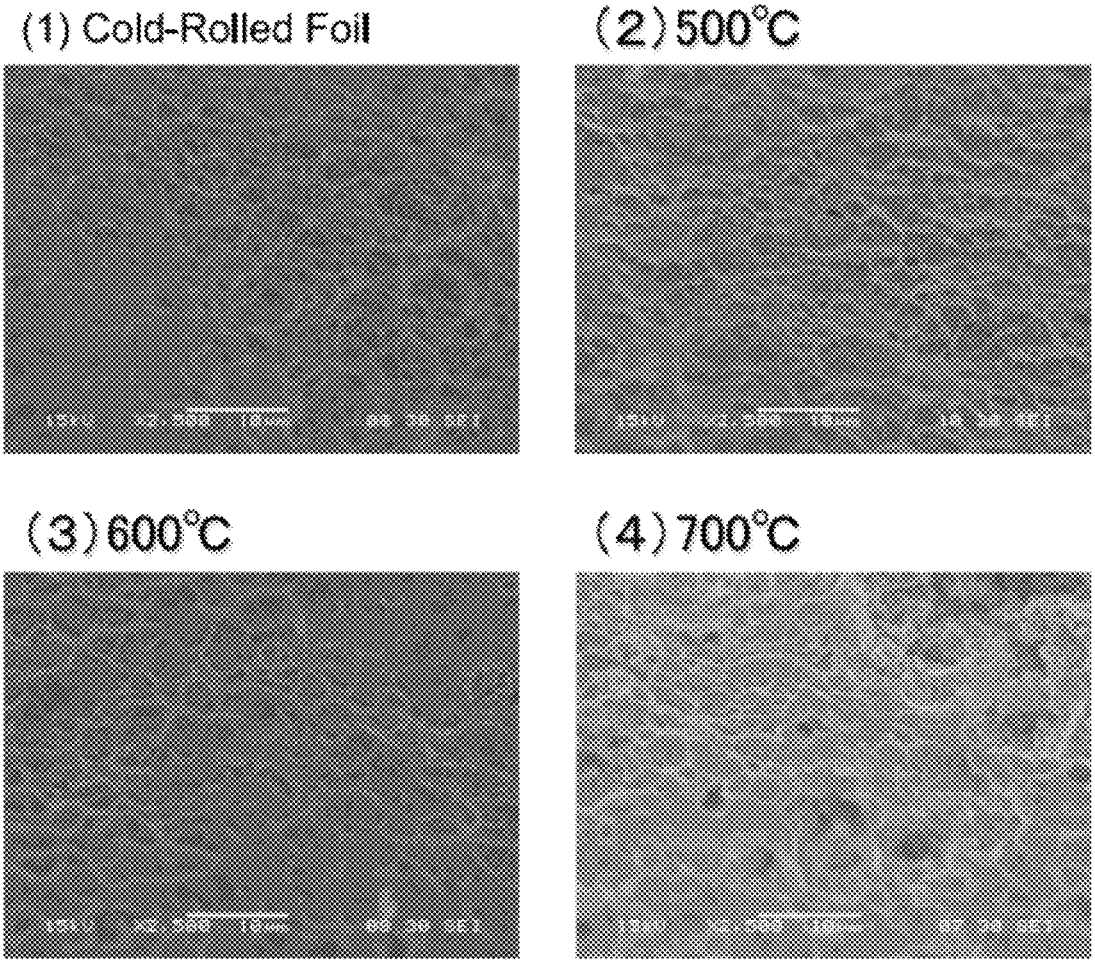
FIG. 10 shows SEM photographs of fracture surfaces of a cold-rolled foil (Example Sample 1) and Example Sample 1 subjected to annealing at 900° C. for 1 hour when subjected to the high-temperature tensile test.

Subsequently, fracture surface observation was performed on Example Sample 1 after the high-temperature tensile test, too. FIG. 10 shows SEM photographs of fracture surfaces of the cold-rolled foil (Example Sample 1) and Comparative Example 1 subjected to annealing at 900° C. for 1 hour. In FIG. 10, (1) shows a fracture surface of the cold-rolled foil, (2) shows a fracture surface of Example Sample 1 subjected to tensile measurement at 500° C., (3) shows a fracture surface of Example Sample 1 subjected to tensile measurement at 600° C., and (4) shows a fracture surface of Example Sample 1 subjected to tensile measurement at 700° C.

In FIG. 10, (1) to (4) have confirmed that grain boundary fracture was inhibited both in the cold-rolled foil and in Example Sample 1 subjected to tensile measurement at each temperature. Supposedly, the ductility is therefore maintained to give excellent elongation characteristics.

As revealed by the results of Demonstration Experiment 1, Example Sample 1 has superior tensile strength and ductility to Comparative Example Sample at room temperature. Even at high temperatures, Example Sample 1 has superior tensile strength and higher ductility, in particular. Accordingly, Example Sample 1 has characteristics preventing rapid progress of metal fracture at high temperatures.

[Demonstration Experiment 2]

Next, Demonstration Experiment 2 was performed to see if intermetallic compounds similar to Example Sample 1 in Demonstration Experiment 1 can be obtained when the W content is varied. Hereinafter, Demonstration Experiment 2 will be described.

(Sample Preparation)

In Demonstration Experiment 2, samples having the two kinds of compositions shown in Table 6 were prepared. Table 6 shows the compositions of intermetallic compounds prepared in Demonstration Experiment 2.

TABLE 6

| | Ni at. % | Si at. % | Ti at. % | W at. % | B wt ppm | Remarks: Shortened sample name |
|---|---|---|---|---|---|---|
| Example Sample 2 | 79.5 | 11.0 | 9.0 | 0.5 | 50 | $Ni_3(Si,Ti)$ + 0.5W or 0.5W |
| Example Sample 3 | 79.5 | 11.0 | 5.5 | 4.0 | 50 | $Ni_3(Si,Ti)$ + 4W or 4W |

The samples in Demonstration Experiment 2 were prepared through (1) Ingot sample preparation step and (2) Homogenization heat treatment step described above in Demonstration Experiment 1. That is, in (1) Ingot sample preparation step, the samples were prepared under the same conditions as in Demonstration Experiment 1 except that the respective metals (purity of each metal: 99.9% by weight or more) and B were weighted so as to form the two kinds of compositions shown in Table 6.

Both the samples shown in Table 6 are examples of the present invention, of which, hereinafter, the sample containing 0.5 atomic % of W is referred to as "Example Sample 2", and the sample containing 4.0 atomic % of W is referred to as "Example Sample 3".

(Sample Evaluation)

(1) Microstructure Observation

Figure 11:
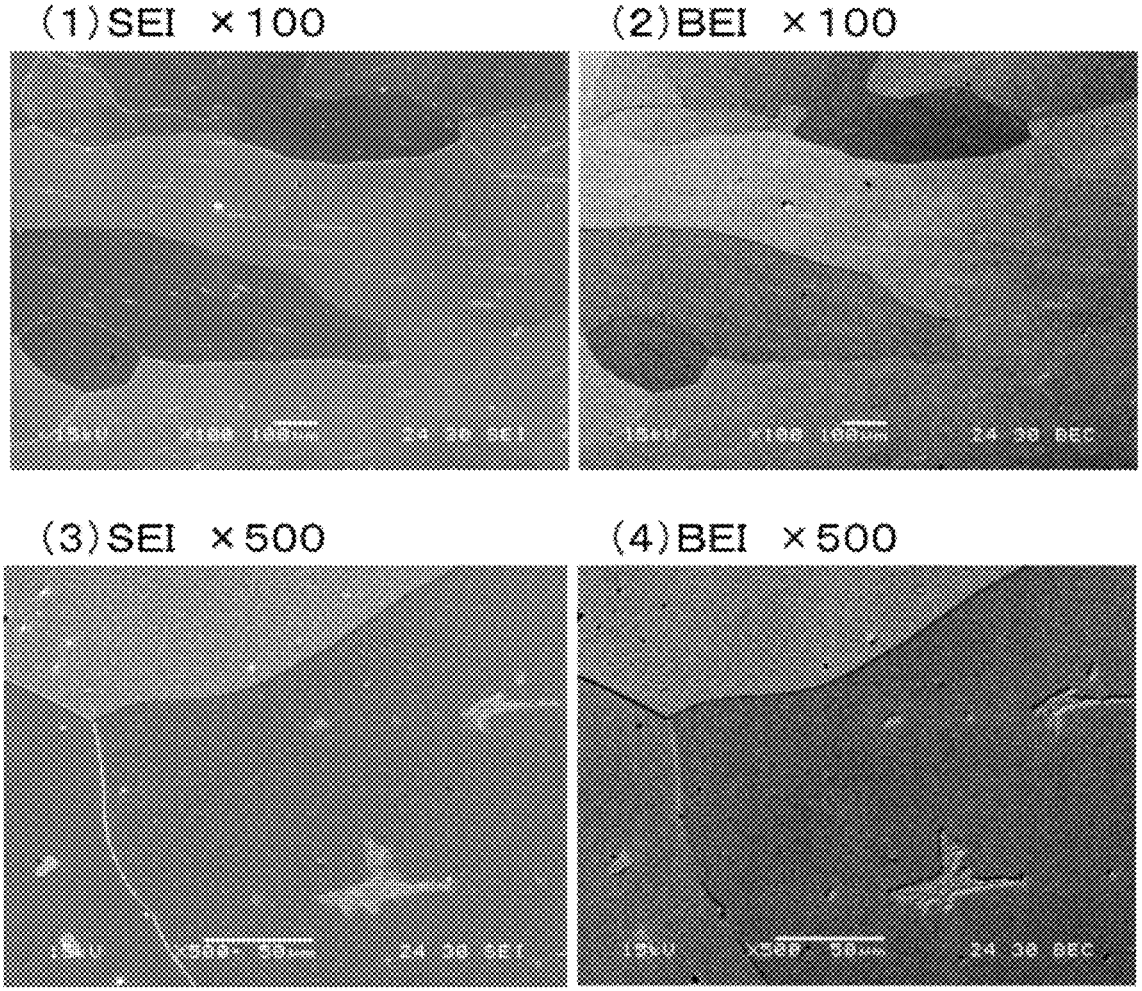
FIG. 11 shows SEM photographs of Example Sample 2.
Figure 12:
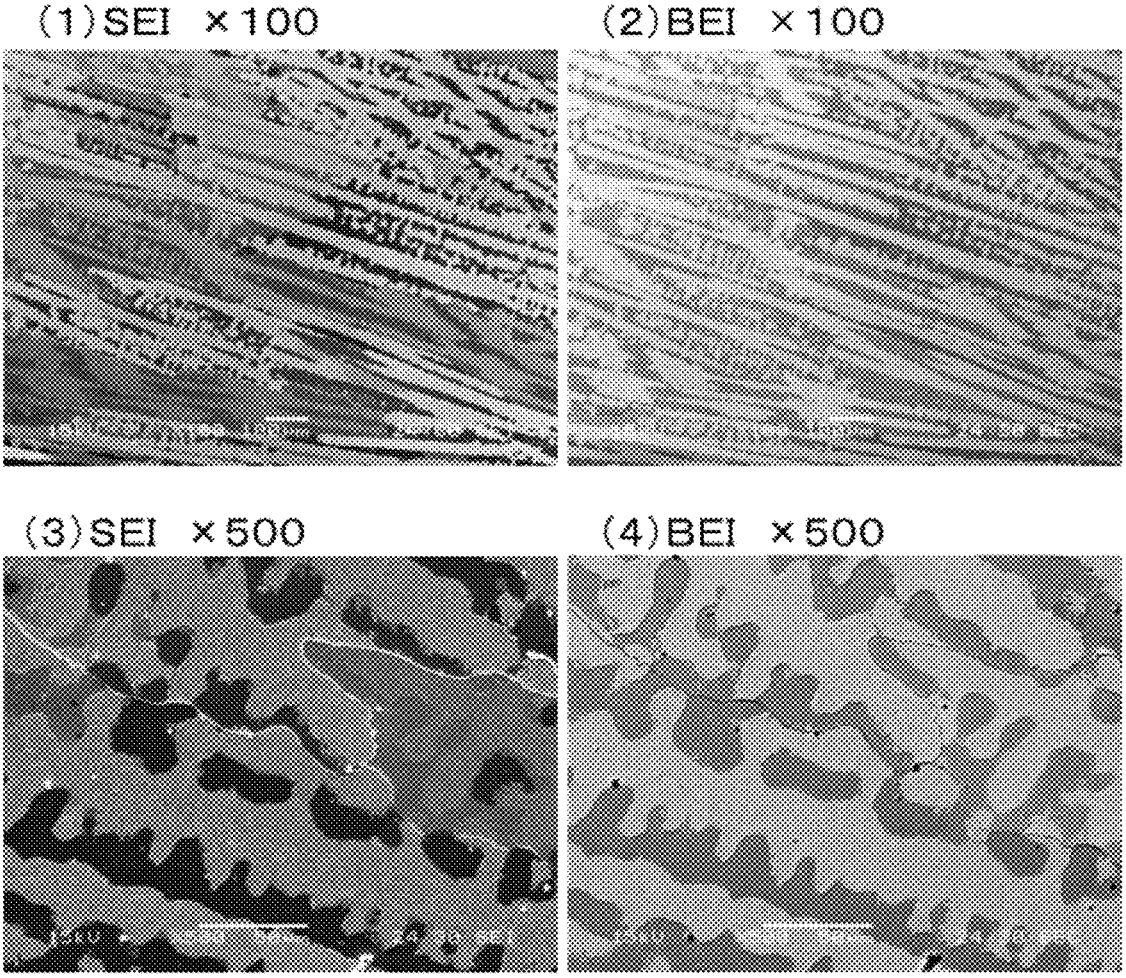
FIG. 12 shows SEM photographs of Example Sample 3.
Figure 13:
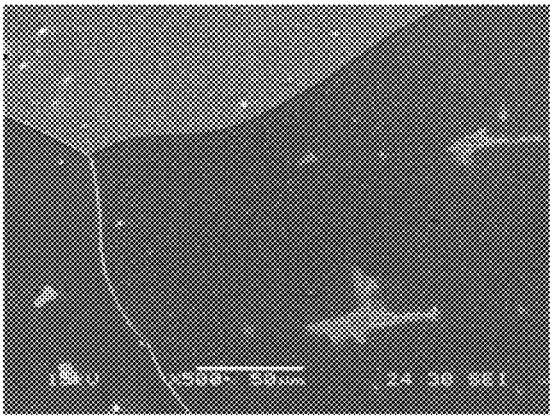
FIG. 13 shows SEM photographs of Example Samples 1-3.
Figure 13:
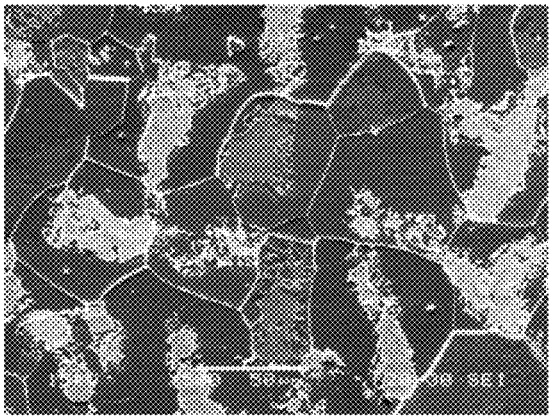
Figure 13:
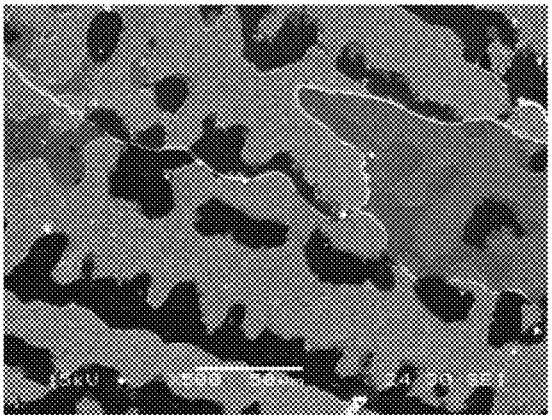

First, microstructure observation (SEM observation) was performed on the samples prepared. FIGS. 11-13 show the observation results. FIG. 11 shows SEM photographs of Example Sample 2, and FIG. 12 shows SEM photographs of Example Sample 3. FIG. 13 shows SEM photographs of Example Samples 1-3. In FIGS. 11 and 12, (1) and (2) are photographs at a magnification of 100 times, and (3) and (4) are photographs at a magnification of 500 times; and (1) and (3) are secondary electron images (SEIs), and (2) and (4) are backscattered electron images (BEIs). In addition, in FIG. 13, (1) is an SEM photograph of Example Sample 2, (3) is an SEM photograph of Example Sample 3 and (2) is an SEM photograph of Example Sample 1 in Demonstration Experiment 1 for reference.

FIG. 11 reveals that a small amount of the second phase (fcc-Ni solid solution phase confirmed in Demonstration Experiment 1) is dispersed in the parent phase of Example Sample 2. In Example Sample 2, the second phase was dispersed in the parent phase almost uniformly as illustrated in (1) and (2) in FIG. 11, while slightly concentrated second phase was observed only in a few areas.

On the other hand, FIG. 12 reveals that a large amount of the second phase (fcc-Ni solid solution phase) is formed to cover the whole area of Example Sample 3. It is revealed that the volume fraction of the second phase of Example Sample 3 is higher than that of Example Sample 2.

Meanwhile, FIG. 13 reveals that the second phase is dispersed in the parent phase in all of Example Samples 1-3. Considering that white areas in the photos (bright areas) represent the fcc-Ni solid solution phase and black areas (dark areas) in the photos represent the $L1_2$ phase in FIG. 13, the volume fraction of the second phase gets higher in order of Example Sample 2 (W content: 0.5 atomic %), Example Sample 1 (W content: 2.0 atomic %) and Example Sample 3 (W content: 4.0 atomic %), indicating that the volume fraction of the second phase increases according to the W content.

(2) Vickers' Hardness Test

Next, a Vickers' hardness test was performed on Example Samples 2 and 3. In the Vickers' hardness test, a square pyramid diamond indenter was pushed into each sample as in the case of Demonstration Experiment 1. The load was 1 kg and the retention time was 20 seconds.

Figure 14:
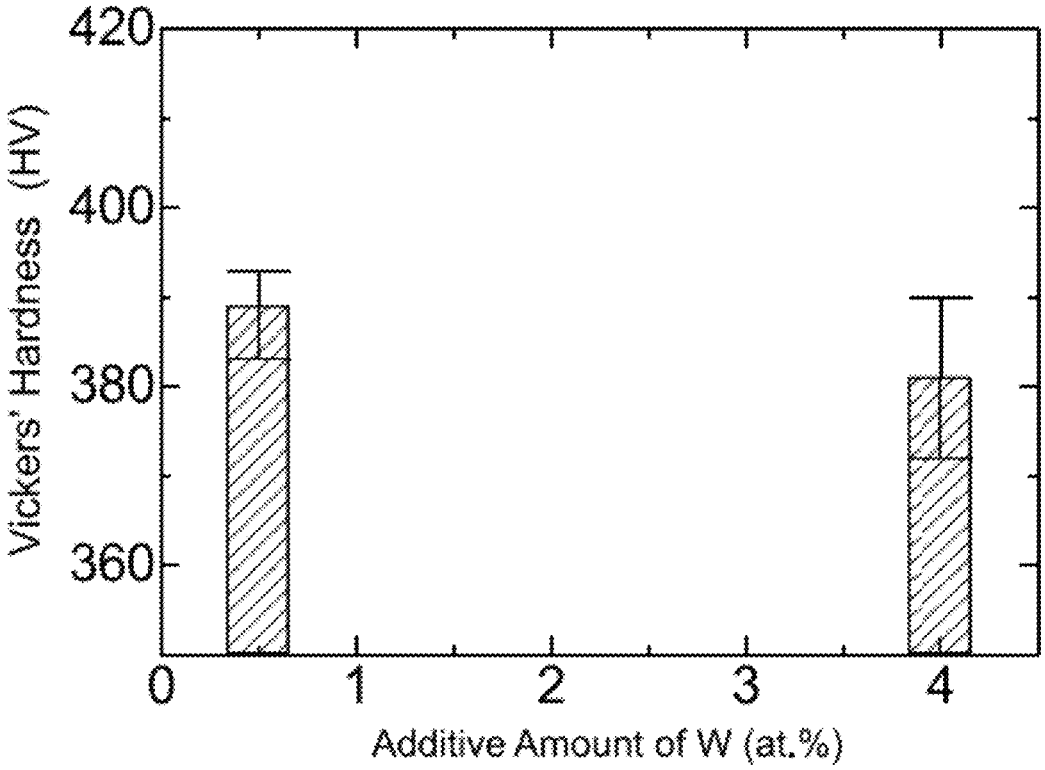
FIG. 14 is a graph showing results of a Vickers' hardness test in Demonstration Experiment 2.

FIG. 14 shows the test results. FIG. 14 is a graph showing the results of the Vickers' hardness test in Demonstration Experiment 2.

FIG. 14 indicates that Example Sample 2 is almost as hard as Example Sample 3, though tending to be slightly harder than Example Sample 3. Table 7 shows the Vickers' hardness of the W-containing samples including Example Sample 1.

TABLE 7

| Sample name | W content (at. %) | Vickers' hardness (HV) |
|---|---|---|
| Example Sample 1 | 2.0 | 399 |
| Example Sample 2 | 0.5 | 389 |
| Example Sample 3 | 4.0 | 381 |

Table 7 reveals that the samples have almost the same hardness, though the samples have greatly different microstructures, having greatly different volume fractions of the parent phase ($L1_2$ phase) or volume fractions of the second phase (fcc-Ni solid solution phase). The results lead to the expectation that Example Samples 2 and 3 as well as Example Sample 1 can be subjected to the same cold rolling step as in Demonstration Experiment 1 and produce comparable effects even when subjected to annealing.

INDUSTRIAL APPLICABILITY

The present invention can be applied to chemical equipment materials (catalyst carriers, chemical container members, and the like), electric/electronic materials and structural materials as materials alternative to stainless steel foils and nickel foils, for example. When applied to these materials, the intermetallic compound of the present invention is workable at high temperatures and easily produced as having excellent ductility characteristics at high temperatures. In addition, the intermetallic compound of the present invention can be attached to another structural member to protect the structure or can be used as a base material for a laminate as being capable of preventing rapid progress.

The invention claimed is:

1. An $Ni_3$(Si, Ti)-based intermetallic compound consisting of an intermetallic composition consisting of 100% by atom in total of Ni as a main component, from 7.5 to 12.5% by atom of Si, from 4.5 to 8.5% by atom of Ti and from 0.5 to 4.0% by atom of W, and 25 to 500 ppm by weight of B with respect to the intermetallic composition, and comprising an $L1_2$ phase and an Ni solid solution phase.

2. The $Ni_3$(Si, Ti)-based intermetallic compound according to claim 1, wherein the intermetallic composition consists of 100% by atom in total of Ni as a main component, from 7.5 to 12.5% by atom of Si, from 5.5 to 8.5% by atom of Ti and from 0.5 to 4.0% by atom of W.

3. The $Ni_3$(Si, Ti)-based intermetallic compound according to claim 2, being obtained through cold rolling at a rolling reduction of from 85 to 99%.

4. A rolled foil of an $Ni_3$(Si, Ti)-based intermetallic compound, the rolled foil made of the $Ni_3$(Si, Ti)-based intermetallic compound according to claim 2 and having a thickness of 20-300 μm.

5. The $Ni_3$(Si, Ti)-based intermetallic compound according to claim 1, wherein the intermetallic composition consists of 100% by atom in total of Ni as a main component, from 10.0 to 12.0% by atom of Si, from 6.5 to 8.5% by atom of Ti and from 1.0 to 3.0% by atom of W, and wherein the weight of B with respect to the intermetallic composition is 25 to 100 ppm.

6. The $Ni_3$(Si, Ti)-based intermetallic compound according to claim 5, being obtained through cold rolling at a rolling reduction of from 85 to 99%.

7. A rolled foil of an $Ni_3$(Si, Ti)-based intermetallic compound, the rolled foil made of the $Ni_3$(Si, Ti)-based intermetallic compound according to claim 5 and having a thickness of 20-300 μm.

8. The $Ni_3$(Si, Ti)-based intermetallic compound according to claim 1, being obtained through cold rolling at a rolling reduction of from 85 to 99%.

9. The $Ni_8$(Si, Ti)-based intermetallic compound according to claim 5, being obtained through annealing at a temperature of from 300 to 1050° C. performed after the cold rolling.

10. A rolled foil of an $Ni_3$(Si, Ti)-based intermetallic compound, the rolled foil made of the $Ni_3$(Si, Ti)-based intermetallic compound according to claim 9 and having a thickness of 20-300 μm.

11. A rolled foil of an $Ni_3$(Si, Ti)-based intermetallic compound, the rolled foil made of the $Ni_3$(Si, Ti)-based intermetallic compound according to claim 8 and having a thickness of 20-300 μm.

12. A rolled foil of an $Ni_3$(Si, Ti)-based intermetallic compound, the rolled foil made of the $Ni_3$(Si, Ti)-based intermetallic compound according to claim 1 and having a thickness of 20-300 μm.

13. A rolled foil of an $Ni_3$(Si, Ti)-based intermetallic compound, the rolled foil made of the $Ni_3$(Si, Ti)-based intermetallic compound according to claim 1 and having a thickness of 20-300 μm.

14. A method for producing a rolled sheet or foil of an $Ni_3$(Si, Ti)-based intermetallic compound, the method comprising:

an ingot preparation step of preparing an ingot containing an intermetallic composition consisting of 100% by atom in total of Ni as a main component, from 7.5 to 12.5% by atom of Si, from 4.5 to 11.5% by atom of Ti and from 0.5 to 5.0% by atom of W, and from 25 to 500 ppm by weight of B with respect to a weight of the intermetallic composition;

a homogenization heat treatment step of performing homogenization heat treatment on the ingot;

a thermomechanical heat treatment step of repeating rolling at a rolling reduction of 10% or more and annealing at a temperature of from 900 to 1100° C. on the ingot after the homogenization heat treatment step three times or more to prepare a sheet material; and a cold rolling step of performing cold rolling on the sheet material at a rolling reduction of from 85 to 99%.

* * * * *